US005135567A

United States Patent [19]

Volotinen et al.

[11] Patent Number: 5,135,567

[45] Date of Patent: Aug. 4, 1992

[54] METHOD FOR PRODUCING METAL POWDERS FROM LIQUID PHASE CONTAINING METAL IONS

[75] Inventors: Heikki J. Volotinen, Lahti; Jyri J. Talja; Pekka A. Taskinen, both of Espoo, all of Finland

[73] Assignee: Outokumpu Oy, Helsinki, Finland

[21] Appl. No.: 710,134

[22] Filed: Jun. 4, 1991

[30] Foreign Application Priority Data

Jun. 5, 1990 [FI] Finland ..... 902815

[51] Int. Cl.[5] ..... B22F 9/26; B22F 9/22; C22B 23/04

[52] U.S. Cl. ..... 75/365; 75/364; 75/371; 75/373; 75/374; 75/717; 75/718

[58] Field of Search ..... 75/364, 365, 374, 717, 75/718, 342, 346, 363, 370, 371, 373; 148/126.1

[56] References Cited

U.S. PATENT DOCUMENTS 4,772,315 9/1988 Johnson et al. ..... 75/342
4,788,517 10/1988 Kopatz et al. ..... 75/342

FOREIGN PATENT DOCUMENTS 0488873 10/1975 U.S.S.R. ..... 75/373
1126374 11/1984 U.S.S.R. ..... 75/374
1316748 6/1987 U.S.S.R. ..... 75/373

*Primary Examiner*—R. Dean
*Assistant Examiner*—Sikyin Ip
*Attorney, Agent, or Firm*—Brooks Haidt Haffner & Delahunty

[57] ABSTRACT

The invention relates to a method for producing metal powders, where the employed raw materials are metal ions in a liquid phase. According to the invention, at a preliminary stage of the method the liquid phase containing metal ions is reduced with hydrogen at an increased pressure and raised temperature in order to produce porous, sponge-like metal powder. The obtained porous, sponge-like metal powder is further processed at a high temperature, for instance by means of plasma, in order to improve the qualities of the metal powder.

4 Claims, No Drawings

METHOD FOR PRODUCING METAL POWDERS FROM LIQUID PHASE CONTAINING METAL IONS

The present invention relates to a method for producing metal powders, and particularly to a method where the employed raw materials are metal ions in a liquid phase.

The EP patent applications 292,792, 292,793 and 292,798 describe processes for producing fine metal powders, where the prevailing particle shape is round. In these processes, to an aqueous acid solution, such as hydrochloric acid HCl, sulphuric acid $H_2SO_4$ or nitric acid $HNO_3$, there is dissolved copper and its alloys, or metals from the iron group, such as iron, nickel or cobalt. The solution is processed, either by means of evaporation or by suitably adjusting the pH-value, to a reducible solid salt, oxide, hydroxide or a mixture of these. The created metal is ground, whereafter it is reduced to metallic powder particles. The obtained powder is ground and conducted, by means of an inert carrier gas, to a hot flame created by means of a plasma torch. In the plasma treatment, the major part of the metal particles melt and forms molten droplets. These molten droplets are cooled, in which case the created metal particles generally are round-shaped, and the average particle size is less than 20 μm. By applying the described methods, the iron-group metals iron, nickel and cobalt can be procesed into powders where the particle shape is essentially round, and the particle size in more than 50% is below 10 μm.

In the above mentioned EP patent applications, there are treated metallic powder particles which are already in particle form, by means of plasma in order to change their particle shape to be better suited for powdermetallurgical further treatments. As was described above, the methods of the EP patent applications 292,792, 292,793 and 292,798 require several different stages prior to the plasma treatment: leaching, evaporation/pH-adjustment, grinding, reduction and regrinding. Thus the production method of powdered material becomes rather complicated.

The object of the present invention is to achieve a simpler method for creating powdered particles, so that the product having an advantageous particle shape is formed in a simple preliminary treatment before the at least partial melting at a high temperature.

According to the invention, in order to produce metal powder particles, cations contained in a liquid phase are reduced into elemental metal, and the created porous metal sponge is treated at a high temperature and in an inert gas atmosphere, in order to achieve an advantageous shape for the metal particles.

In the method of the invention, the particle shape of powders produced from aqueous solutions or organic solutions through a chemical reduction process is an extremely nonhomogeneous and porous agglomerated metal sponge, and therefore these products have a poor fluidity, a low component density and a high reactivity, for instance a tendency towards oxidation. By subjecting the obtained metal sponge to a high-temperature treatment, for instance by means of plasma, the shape of the powder agglomerates is changed to be essentially spherical. At the same time, the typical porous structure of the metal sponge can be condensed. Consequently, owing to the high-temperature treatment, the specific surface of the metal powders is decreased, their bulk density increased and fluidity improved, simultaneously as their chemical reactivity is reduced.

By employing the method of the invention, there can advantageously be produced metal powders or metal alloy powders, essentially regular in particle shape, of essentially fine particle classes, where the particle size is advantageously less than 100 μm. The method can be applied for several different materials, such as copper and nickel and alloys thereof.

In the method of the invention, copper is reduced, advantageously within the temperature range 80°-150° C., at the hydrogen pressure 15-35 bar, and nickel within the temperature range 140°-160° C., at the hydrogen pressure 10-30 bar.

The invention is below explained with reference to the appended examples. It is by no means our wish, however, to restrict the invention to these examples only, but many changes and modifications are possible within the scope of the appended patent claims.

EXAMPLE 1

From an aqueous solution, with a copper content of 80 g/l, there was reduced copper by means of hydrogen, in an autoclave, at an increased hydrogen pressure 20 bar and at a raised temperature 150° C. The reduced copper formed porous, sponge-like copper powder, wherefrom a fraction with a particle size 45-63 μm was screened.

The screened copper powder fraction was fed, by means of a carrier gas, through a feed pipe, i.e. lance, to a plasma ball created according to the induction principle, where the temperature was 8,000° C. The employed carrier gas was nitrogen 11.3 $Ndm^3$/min, the plasma gas was argon 40 $Ndm^3$/min, and the protective gas was argon 100 $Ndm^3$/min. The input power of the plasma equipment was 45-48 kVA.

The fluidity of the copper powder was measured by the Hall fluidity test. The fluidity of the feed was 1.3 g/s, and bulk density 2.3 g/$cm^3$. In addition to this, there was defined the specific surface of the feed, which was 1.08 $m^2$/g, and the average particle size of the feed, 60 μm.

For the sake of comparison, the same quantities where also measured from the product. With a feed rate of 6.3 kg/h, the fluidity of the product was 3.5 g/s, the bulk density 3.3 g/$cm^3$ and specific surface 0.2 $m^2$/g. The average particle size of the product was measured as 56 μm.

When comparing the values of the product to those of the feed, it is observed that for instance the fluidity of the product is nearly threefold in comparison to the feed. Likewise, the specific surface of the product is only about one fifth of the corresponding value of the feed. On the basis of these readings it can be stated that the product mainly contains only condensed, spherical particles, which is advantageous for the further treatment of the powder.

EXAMPLE 2

Nickel was reduced from an organic Versatic 10 solution, where the nickel content was 20 g/l, in an autoclave with hydrogen, at an increased hydrogen pressure 10 bar and at a raised temperature 140° C. The obtained final product was a porous, sponge-like nickel powder.

The nickel powder obtained from the hydrogen reduction was washed with alcohol, dried and fed as such, by means of a carrier cas, through a feed pipe, i.e. lance, to a hot flame, which was argon plasma created according to the induction principle, where the temperature was about 8,000° C. As the carrier gas, there was fed in nitrogen 14.5 $Ndm^3$/min, as the plasma gas argon 40 $Ndm^3$/min, and as the protective gas argon 100 $Ndm^3$/min. The rate of supplied nickel was 2.52 kg/h, and the input power of the plasma equipment was 48–50 kVA.

The bulk density of the nickel powder prior to the plasma treatment was 1.0 g/$cm^3$, and after the plasma treatment 2.6 g/$cm^3$. From these results it is observed that the plasma treatment has remarkably condensed the nickel powder particles, which at the same time has increased the formation of spherical particles.

We claim:

1. A method for producing metal powders from metal ions in a liquid phase, by:

(a) reducing the liquid phase containing the metal ions at hydrogen pressure 10 to 35 bar and temperature 80° to 160° C. to produce porous, sponge-like metal powder; and (b) subjecting the porous, sponge-like powder from step (a) to high temperature plasma treatment to improve the qualities of the metal powder.

2. The method of claim 1, including carrying out the hydrogen reduction in an autoclave.

3. The method of claim 1 or 2, wherein the metal ion to be treated is copper.

4. The method of claim 1 or 2 wherein the metal ion to be treated is nickel.

* * * * *